US009372041B1

(12) United States Patent
Geissele

(10) Patent No.: US 9,372,041 B1
(45) Date of Patent: Jun. 21, 2016

(54) ARMORER TOOL

(71) Applicant: WHG Properties, LLC, North Wales, PA (US)

(72) Inventor: William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 14/790,567

(22) Filed: Jul. 2, 2015

Related U.S. Application Data

(63) Continuation-in-part of application No. 29/514,275, filed on Jan. 9, 2015.

(51) Int. Cl.
*F41A 11/00* (2006.01)

(52) U.S. Cl.
CPC ..... *F41A 11/00* (2013.01)

(58) Field of Classification Search
CPC ..... F41A 11/00; F41C 27/00
USPC ..... 42/108, 90
See application file for complete search history.

(56) References Cited

PUBLICATIONS https://www.botach.com./kley-zion-armors-ar15-m4-barrel-spline-socket-rod/ (retrieved Jul. 10, 2015).
http://geissele.com/reaction-rod.html (retrieved Jul. 10, 2015).

*Primary Examiner* — Reginald Tillman, Jr.
(74) *Attorney, Agent, or Firm* — Merchant & Gould, P.C.

(57) ABSTRACT

An armorer tool for distributing the torque associated with assembling and disassembling components of a firearm.

20 Claims, 10 Drawing Sheets

ARMORER TOOL

CROSS-REFERENCE TO RELATED APPLICATIONS

This application is a continuation-in-part of U.S. patent application Ser. No. 29/514,275 filed Jan. 9, 2015, the disclosure of which is hereby incorporated by reference in its entirety.

BACKGROUND

Armorers frequently remove or install various firearm parts, such as barrels, flash suppressors, gas blocks, and handguards to perform maintenance, adjustment, parts replacement, or initial parts installation. Removal and installation of such parts often requires the application of torque about the part or a related component that secures the part in question to the firearm. An example of such a component is a barrel nut, which secures the firearm barrel to the firearm upper receiver. A common problem associated with removal and mounting of such firearm parts and related components is the tendency for the torque applied during the removal or mounting actions to be transferred to other parts of the firearm, which can cause unwanted damage thereto.

SUMMARY

In general terms, this disclosure is directed to an armorer tool for distributing the torque associated with assembling and disassembling components of a firearm, and methods therefor.

In one aspect, an armorer tool for use with a barrel and an upper receiver of a firearm comprises an elongate member comprising a front portion, a rear portion, and a body portion between the front portion and the rear portion, the front portion comprising a plurality of splines configured to mate with the firearm barrel, the rear portion comprising a surface configured to mate with a support mechanism; and at least one protrusion protruding beyond a profile of the body portion and disposed on the body portion at a location aligned with an ejection port of the upper receiver when the armorer tool extends through the upper receiver and is mated to the barrel.

In another aspect, a method for securing a firearm barrel nut to a barrel and an upper receiver of a firearm using an armorer tool comprises: securing a rear portion of the armorer tool to a support mechanism; sliding the upper receiver over the armorer tool until a well in the armorer tool is aligned with an ejection port in the upper receiver; inserting a barrel into the upper receiver such that a front end of the armorer tool mates with the barrel; securing a protrusion to the well of the armorer tool such that the protrusion contacts a rim surrounding the ejection port; and securing the barrel nut around the upper receiver and the barrel.

In yet a further aspect, a method for removing a firearm barrel nut from a barrel and an upper receiver of a firearm using an armorer tool comprises: securing a rear portion of the armorer tool to a support mechanism; sliding the upper receiver and the barrel over the armorer tool until a well in the armorer tool is aligned with an ejection port in the upper receiver; securing a protrusion to the well of the armorer tool such that the protrusion contacts a rim surrounding the ejection port; and removing the barrel nut from the upper receiver and the barrel.

DETAILED DESCRIPTION

Figure 1:
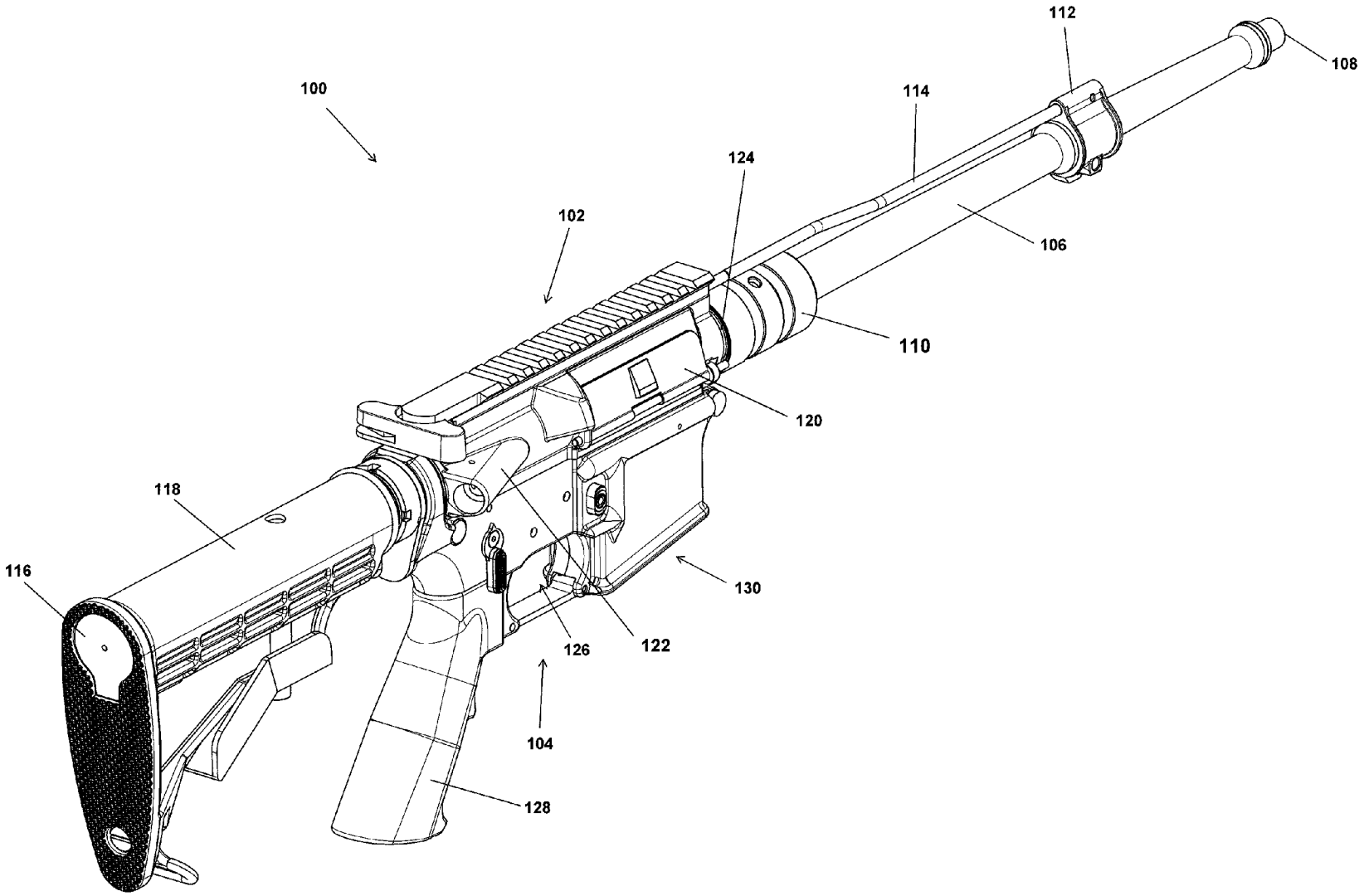
FIG. 1 is a rear, top, right side, perspective view of an example firearm.

Various embodiments are described herein in detail with reference to the drawings, wherein like reference numerals represent like parts and assemblies throughout the several views. Reference to various embodiments does not limit the scope of the appended claims. Additionally, any examples set forth in this specification are not intended to be limiting and merely set forth some of the many possible embodiments for the appended claims.

FIG. 1 is a rear, top, right side, perspective view of an example firearm. In this example, the firearm 100 includes an upper receiver 102, a lower receiver 104, a barrel 106, a muzzle 108, a barrel nut 110, a gas block 112, a gas tube 114, a buffer tube 116, and a stock 118. The upper receiver 102 includes an ejection port cover 120, a forward assist plunger tube 122 and a barrel receiving end 124. The lower receiver 104 includes a trigger mechanism 126, a hand grip 128, and a magazine well 130.

The firearm 100 can be of a variety of different types. Examples of the firearm 100 include, but are not limited to, handguns, rifles, shotguns, carbines, machine guns, submachine guns, personal defense weapons, automatic rifles, and assault rifles. In at least one embodiment, the firearm 100 is an AR-15, M-16 or M-4 type rifle, or one of their variants.

The upper receiver 102 defines an internal longitudinally-extending cavity configured to receive a bolt assembly. The bolt assembly is slidably disposed in the cavity for axially reciprocating recoil movement therein. In at least one embodiment, the upper receiver 102 is an AR-15, M-16 or M-4 type upper receiver, or one of their variants.

The lower receiver 104 is situated below the upper receiver 102 and is involved in triggering the firearm 100. The barrel 106 includes an internal, longitudinally extending bore that ends at the muzzle 108 at the front of the firearm 100, where a projectile (e.g., a bullet) exits the firearm. The barrel 106 is in open communication with the upper receiver 102. The example barrel nut 110 secures the barrel 106 to the upper receiver 102.

The gas block 112 and the gas tube 114 operate to divert some of the gases generated from a fired projectile back into the upper receiver 102 to assist in cycling the firearm for repeated firing. The buffer tube 116 is situated behind the firing chamber and reduces the recoil of the firearm caused by the motion of the firing bolt assembly during firing. Buffer tubes typically include a buffer pin, a buffer spring for recoil reduction, as well as a castle nut and an endplate. The stock 118 surrounds the buffer tube 116 and provides support to the operator holding the firearm 100 to steady and aim the firearm 100 during firing. The stock 118 also operates to transmit recoil generated from firing the firearm to the body of the shooter.

The ejection port cover 120 covers the ejection port (not shown in FIG. 1) in the upper receiver through which spent projectile cartridges are ejected during firing of the firearm 100. Typically, the ejection port cover 120 is flipped down when the firearm 100 is in operation to expose the ejection port. When the example firearm 100 is not in use, the ejection port cover 120 covers the ejection port to protect the ejection port and to prevent unwanted dirt, dust, or other foreign material from entering the upper receiver 102. The forward assist plunger tube 122 typically houses a forward assist plunger (not shown). Pushing on the forward assist plunger compresses a spring inside the forward assist plunger tube 122 and functions as a collateral, manual means of loading a round of ammunition from the magazine into the chamber for firing the firearm.

The barrel receiving end 124 of the upper receiver 102 is tubular, exteriorly surrounded by screw threads, and situated at the front end of the upper receiver 102. In this example firearm, a barrel nut extension (not shown in FIG. 1) at the rear end of the barrel 106 is inserted into barrel receiving end 124 in the upper receiver 102 to mount the barrel 106 on the upper receiver 102. Then, the barrel nut 110, having corresponding interior screw threads, is tightened, typically with a torque wrench, about the barrel receiving end of the upper receiver 102 and the barrel nut extension of the barrel 106 in order to secure the barrel 106 to the upper receiver 102. To remove the barrel 106 from the upper receiver 102, a torque wrench is typically used to unscrew the barrel nut 110 from the barrel 106 and the barrel receiving end 124 of the upper receiver 102.

The trigger mechanism 126 of the lower receiver 104 operates the trigger of the firearm 100. The hand grip 128 is typically held by the shooter of the firearm 100 during use, and the magazine well 130 holds the firearm's magazine of ammunition.

The upper receiver 102 and the lower receiver 104 are configured to house a firing mechanism and associated components as found in, for example, AR-15, M-16 or M-4 type rifles and their variants. Such a firing mechanism typically includes a spring-biased hammer that is cocked and then released by a sear upon actuating a triggering mechanism. The hammer strikes a firing pin carried by a bolt, which in turn is thrust forward to contact and discharge a cartridge loaded in a chamber. A portion of the expanding combustion gases traveling down the barrel is discharged off (such as by means of the gas block 112 and the gas tube 114 as discussed above) and used to drive the bolt rearward against a forward biasing force of a recoil spring for automatically ejecting the spent cartridge casing and automatically loading a new cartridge into the chamber from a magazine when the bolt returns forward.

Figure 2:
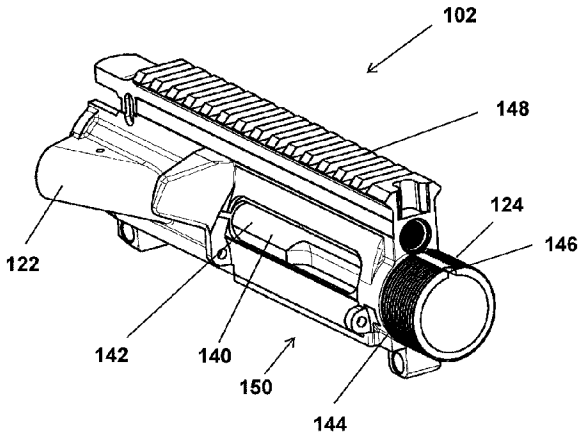
FIG. 2 is a front, top, right side perspective view an example firearm upper receiver.

FIG. 2 is a front, top, right side perspective view of an example firearm upper receiver 102. The upper receiver 102 includes the forward the assist plunger tube 122 and the barrel receiving end 124 as described above. In addition, in this example, the upper receiver 102 includes an ejection port 140, a cavity 142, screw threads 144, a recess 146, a top 148, and a bottom 150. The upper receiver 102 differs from the upper receiver 102 in FIG. 1 in that the ejection port cover 120 has been removed.

When the firearm (such as the firearm 100 discussed above) is being operated, spent ammunition cartridges are ejected through the ejection port 140 from the cavity 142. When the firearm is assembled, the cavity 142 is in open communication with the barrel of the firearm. Screw threads 144 on the exterior of the barrel receiving end 124 mate with corresponding screw threads on the interior of a barrel nut (not shown) to secure the barrel to the upper receiver 102.

The recess 146 mates with a corresponding pin on the barrel nut extension of a barrel (see discussion below in connection with FIG. 3), allowing the barrel and the upper receiver 102 to properly mate in just a single orientation. The placement of the barrel nut extension pin in the recess 146 also prevents motion of the upper receiver 102 relative to the barrel, and vice versa, when the barrel nut is mounted or removed from the firearm assembly. The interaction between the barrel nut extension pin, barrel, and upper receiver is discussed below in greater detail.

Figure 3:
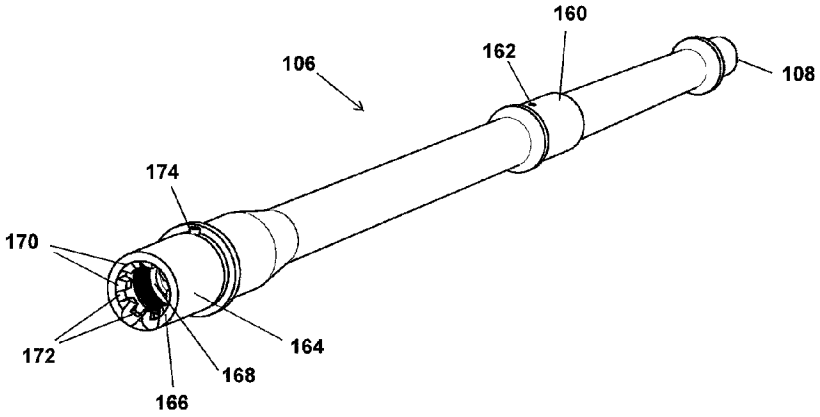
FIG. 3 is a rear, top, right side perspective view of an example firearm barrel.

FIG. 3 is a rear, top, right side perspective view of an example firearm barrel. Barrel 106 includes the muzzle 108 as discussed above. In addition, in this example, the barrel 106 includes a gas block mounting ring 160, a gas vent 162, a barrel nut extension 164 having a rear end 166, an interior bore 168, lugs 170, spaces 172, and a pin 174.

A gas block (such as the gas block 112 shown in FIG. 1) can be mounted to the gas block mounting ring 160. Some gas generated from firing a firearm (such as the firearm 100 in FIG. 1) is redirected through the gas vent 162. When a gas block is mounted to the barrel 106, such gas can then travel through the gas tube 114 as described above in connection with FIG. 1. The barrel nut extension 164 is situated toward the rear of the barrel 106 and extends to the rear end 166 of barrel 106. The barrel nut extension 164 is configured to mate with an upper receiver (such as upper receiver 102 in FIG. 2), by being inserted into the barrel receiver end (such as barrel receiving end 124 in FIG. 2) of the upper receiver. The interior bore 168 extends the entire length of barrel 106 and is in open communication with the upper receiver of the firearm when the barrel 106 is mated to the upper receiver 102 (FIG. 2). When firing the firearm, each projectile travels through the interior bore 168 and exits the firearm at the muzzle 108.

In this example barrel 106, a plurality of lugs 170 surround the interior surface of the rear end 166 of the barrel nut extension 164 of barrel 106. Between the lugs are spaces 172 configured to mate with and house the splines of an armorer tool in accordance with the present disclosure as described below, which can be used to assist in the mounting/removing of a barrel nut (such as the barrel nut 110 in FIG. 1) or other firearm components from a firearm (such as the firearm 100 of FIG. 1).

The pin 174 is configured to mate with a recess (such as the recess 146 in FIG. 2) in the barrel receiving end (such as the barrel receiving end 124 in FIG. 2) of the upper receiver of a firearm. As a result of the mating of the pin 174 with the recess to establish a pin-recess fitting, the barrel 106 can be properly mounted to the upper receiver in only one orientation, i.e. the orientation in which the pin 174 mates with the recess 146. Nesting the pin 174 in the recess 146 keeps the barrel 106 stationary relative to upper receiver 102, and vice versa, when other firearm components are mounted thereto or removed therefrom.

In the process of applying torque to a barrel nut (such as barrel nut 110) or other firearm component to mount the component to the firearm or remove the component from the firearm, the torqueing results in a friction between the component being torqued and other parts of the firearm, such as the barrel and the upper receiver. The friction results in some of the torque being transferred to these other parts of the firearm such as the barrel and the upper receiver. For example, mounting a barrel nut 110 (see FIG. 1) onto an upper receiver 102 (see FIG. 2) and barrel 106 (see FIG. 3) requires applying a high magnitude of torque, typically with a torque wrench. Through friction generated between the various components (which are typically manufactured of a high density metal or metal alloy resulting in high friction between parts), some of this torque is redirected to the barrel 106 and/or the upper receiver 102. This torque can damage the barrel 106 and/or the upper receiver 102 in a variety of ways, including but not limited to sheering or otherwise wearing down the pin 174 and/or the recess 146 that holds the barrel 106 stationary relative to the upper receiver 102. Torque can be especially damaging when heavily applied to overcome, for example, a barrel nut that has been over-torqued into position, seized, and/or adhered with an adhesive to the upper receiver and/or the barrel of the firearm.

Figure 4:
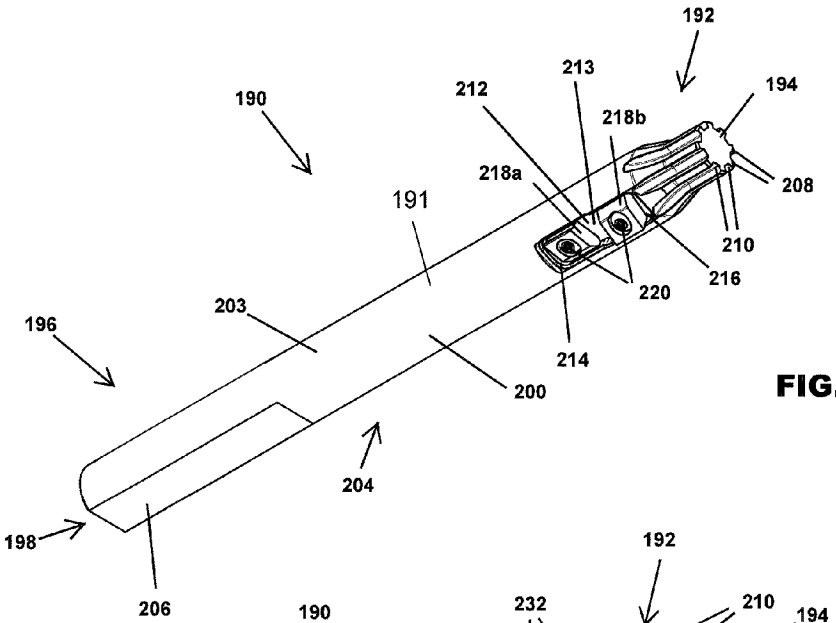
FIG. 4 is a top, front, right side perspective view of an example armorer tool in accordance with the present disclosure.

FIG. 4 is a top, front, right side perspective view of an example armorer tool 190 in accordance with the present disclosure. The example armorer tool 190 includes an elongate member 191, protrusions 218*a* and 218*b*, and screws 220.

The elongate member 191 forms the main body of the armorer tool and has an elongate shape. In some embodiments, the elongate member 191 includes a front portion 192, a front end 194, a rear portion 196, a rear end 198, a body portion 200, a top 202, a bottom 204, a surface 206, splines 208, grooves 210, a well 212 having a bottom surface 213, a rear portion 214, and a front portion 216.

The front portion 192 of the example armorer tool 190 is configured to mate with the barrel nut extension (such as the barrel nut extension 164 in FIG. 3). To mate the barrel nut extension with the armorer tool, the cog-shaped flat front end 194 of the armorer tool is inserted in the barrel nut extension. The rear portion 196 is at the opposite end of the armorer tool 190 from the front portion 192. The rear end 198 is flat with two rounded sides and two straight sides (see FIG. 5). The rear end 198 is parallel to the front end 194. The body portion 200 is substantially cylindrical and situated between the front portion 192 and the rear portion 196.

The top 202 of the example armorer tool 190 faces the top of the upper receiver (such as the top 148 in FIG. 2) when the armorer tool 190 is properly mounted in an upper receiver of a firearm (such as the upper receiver 102 in FIG. 2). The bottom 204 of the armorer tool 190 faces the bottom of the upper receiver (such as the bottom 150 in FIG. 2) when the armorer tool 190 is properly mounted in an upper receiver of a firearm. The surface 206 is at least substantially flat and situated between the top 202 and the bottom 204 in the rear portion 196 of the example armorer tool 190. In this example embodiment, a second surface identical to the surface 206 is disposed on the other side of the rear portion 196 of the armorer tool 190, parallel to the surface 206. The surface 206 (and the parallel surface on the opposite side of the armorer tool 190) are configured to be sandwiched in a vise, such as a bench vise, for holding armorer tool 190 in place during use. The interaction between the surface 206 (and the parallel surface on the opposite side of armorer tool 190) and a support mechanism (such as a vise) is discussed in greater detail below in connection with FIG. 12.

A plurality of splines 208, with grooves 210 therebetween, surround the front portion 192 of the example armorer tool 190. The splines 208 are configured to mate with corresponding spaces (such as spaces 172 in FIG. 3) of a barrel nut extension (such as barrel nut extension 164 in FIG. 3) when the front portion 192 of the armorer tool 190 is inserted in the barrel nut extension. Likewise, the grooves 210 are configured to mate with corresponding lugs (such as the lugs 170 in FIG. 3) of a barrel nut extension when the front portion 192 of the armorer tool 190 is inserted in the barrel nut extension.

The well 212 is a depression in the side of the body portion 202 of the example armorer tool 190, disposed toward the front end of the body portion 202 on the right side of the armorer tool 190 between the top 202 and the bottom 204 of the armorer tool 190. In this example, the well 212 is biased toward the top 202 of the armorer tool 190 and away from the bottom 204 of the armorer tool 190, as described in greater detail below in connection with FIG. 6. In this example, the bottom surface 213 of the well 212 is flat. This well 212 also includes a rear portion 214, which is offset from front portion 216 of the well 212 in that rear portion 214 is further biased toward the top 202 of the armorer tool 190 relative to the front portion 216, and the front portion 216 is biased toward the bottom 204 of the armorer tool 190 relative to the rear portion 214. In alternative embodiments the well does not include a rear portion that is offset relative to a front portion.

In this example a first protrusion 218*a* is disposed in the rear portion 214 of the well 212, and a second protrusion 218*b* is disposed in the front portion 216 of the well 212. In alternative embodiments, the armorer tool includes a single protrusion or, alternatively, more than two protrusions.

In the example armorer tool 190, the protrusions 218*a* and 218*b* are removably secured to the bottom surface 213 of the well 212 with the screws 220. The protrusions 218*a* and 218*b* are threaded to receive the screws 220. In alternative embodiments, other suitable means for securing the protrusions 218*a* and 218*b* to the armorer tool 190 can be used.

Figure 5:
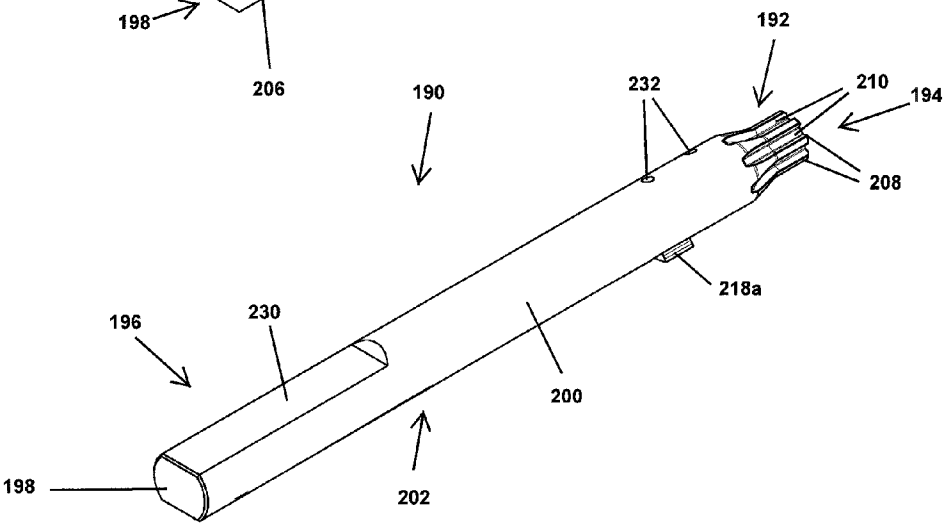
FIG. 5 is a top, rear, left side perspective view of the armorer tool of FIG. 4.

FIG. 5 is a top, rear, left side perspective view of the armorer tool 190 of FIG. 4. In this example, the armorer tool 190 includes the front portion 192, the rear portion 196, the rear end 198, the body portion 200, the top 202, the bottom 204, the splines 208, the grooves 210, and the protrusion 218*a* as discussed above. In addition, in this example, the rear portion 196 includes a surface 230, and screw holes 232.

The surface 230 is at least substantially flat and opposite the surface 206 (see FIG. 3). Together, the surfaces 206 (see FIG. 3) and 230 are configured to be sandwiched in a support mechanism (such as a vise) as discussed in greater detail below in connection with FIG. 12. Screw holes 232 extend through the front end of the body portion 200 from the left side (shown in FIG. 5) to the well 212 (see FIG. 9) on the right side of the armorer tool 190, and correspond with screws 220 (see FIG. 4) which are screwed into the screw holes 232 inside the well 212 (see FIG. 4).

Figure 6:
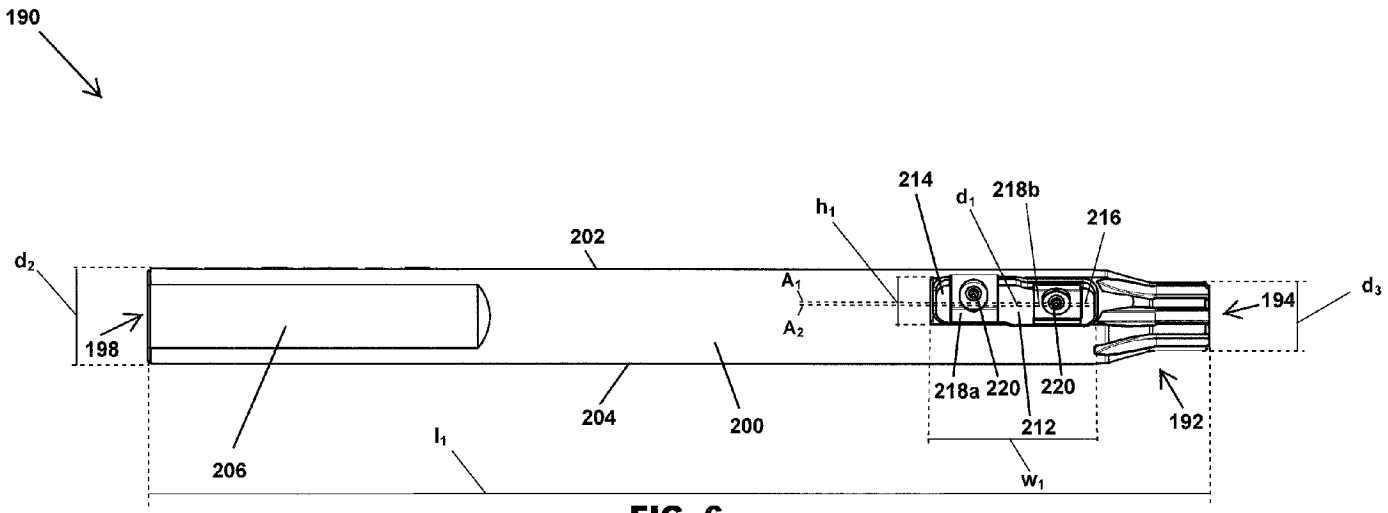
FIG. 6 is a right side view of the armorer tool of FIG. 4.

FIG. 6 is a right side view of the armorer tool 190 of FIG. 4. The armorer tool 190 includes the front portion 192, the front end 194, the rear portion 196, the rear end 198, the body portion 200, the top 202, the bottom 204, the surface 206, the well 212 having the rear portion 214 and the front portion 216, the protrusions 218*a* and 218*b*, and the screws 220, as discussed above.

As shown in FIG. 6, the rear portion 214 of the well 212 is offset toward the top 202 of the example armorer tool 190 relative to the front portion 216 of the well 212. Likewise, the front portion 216 of the well 212 is offset toward the bottom 204 relative to the rear portion 214. The rear portion 214 and the front portion 216 of the well 212 are offset from each other by a distance $d_1$ measured between lines $A_1$ and $A_2$, which longitudinally bisect the rear portion 214 and the front portion 216, respectively. In one example embodiment $d_1$ is about 0.75 mm. In a further example $d_1$=0, i.e. the rear portion 214 and the front portion 216 of the well 212 are not offset from each other. In further alternative examples $d_1$ is in a range from about 0 mm to about 3 mm. The reason for the offset between the rear portion 214 and the front portion 216 of the well 212 is discussed in greater detail below in connection with FIGS. 10-11.

As further shown in FIG. 6, the example armorer tool 190 has a diameter $d_2$ between the top 202 and the bottom 204, a diameter $d_3$ at the front end 194, and a length $l_1$ between the front end 194 and the rear end 198. The well 212 has a width $w_1$. The rear portion 214 of the well 212 has a height $h_1$. The front portion 216 of the well 212 has a height $h_2$. In one example, $d_2$ is about 25 mm, $d_3$ is about 18 mm, $l_1$ is about 285 mm, $w_1$ is about 44 mm, $h_1$ is about 13 mm, and $h_2$ is about 13 mm. In alternative examples, $d_2$ is in a range from about 15 mm to about 35 mm, $d_3$ is in a range from about 10 mm to about 30 mm, $l_1$ is in a range from about 200 mm to about 400 mm, $w_1$ is in a range from about 25 mm to about 75 mm, $h_1$ is in a range from about 5 mm to about 25 mm, and $h_2$ is in a range from about 5 mm to about 25 mm.

Figure 7:
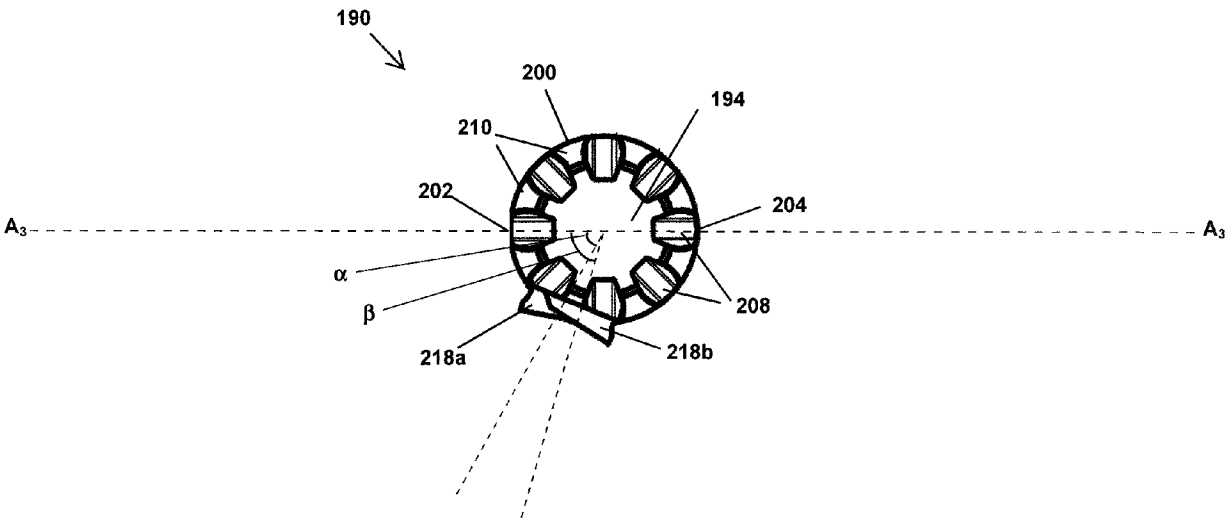
FIG. 7 is a front view of the armorer tool of FIG. 4.

FIG. 7 is a front view of the armorer tool 190 of FIG. 4. The armorer tool 190 includes the front end 194, the body portion 200, the top 202, the bottom 204, the splines 208, the grooves 210 and the protrusions 218*a* and 218*b* as discussed above.

As shown in FIG. 7, the protrusion 218*a*, as measured through its midpoint, is offset from the top 202 of the example armorer tool 190 by an angle $\alpha$ from the axis $A_3$ that travels through the top 202 and the bottom 204 of the armorer tool 190. The protrusion 218*b*, as measured through its midpoint, is offset from the top 202 of the example armorer tool 190 by an angle $\theta$ from the axis $A_3$. In one example embodiment, $\alpha$ is about 58° and $\beta$ is about 79°. In alternative examples, $\alpha$ and $\beta$ can be other values in the range from 0° to 360°. Appropriate values and relative values for angles $\alpha$ and $\beta$ for coordinating use of the armorer tool with specific firearm upper receivers is discussed in greater detail below in connection with FIGS. 10-11.

As further shown in FIG. 7, in the example armorer tool 190 the protrusions 218*a* and 218*b* protrude beyond the profile of the body portion 200 of the armorer tool 190, thereby enabling the protrusions 218*a* and 218*b* to engage the rim of the ejection port of the upper receiver of a firearm that is housing the armorer tool 190. This is discussed in greater detail below in connection with FIGS. 10-11.

Figure 8:
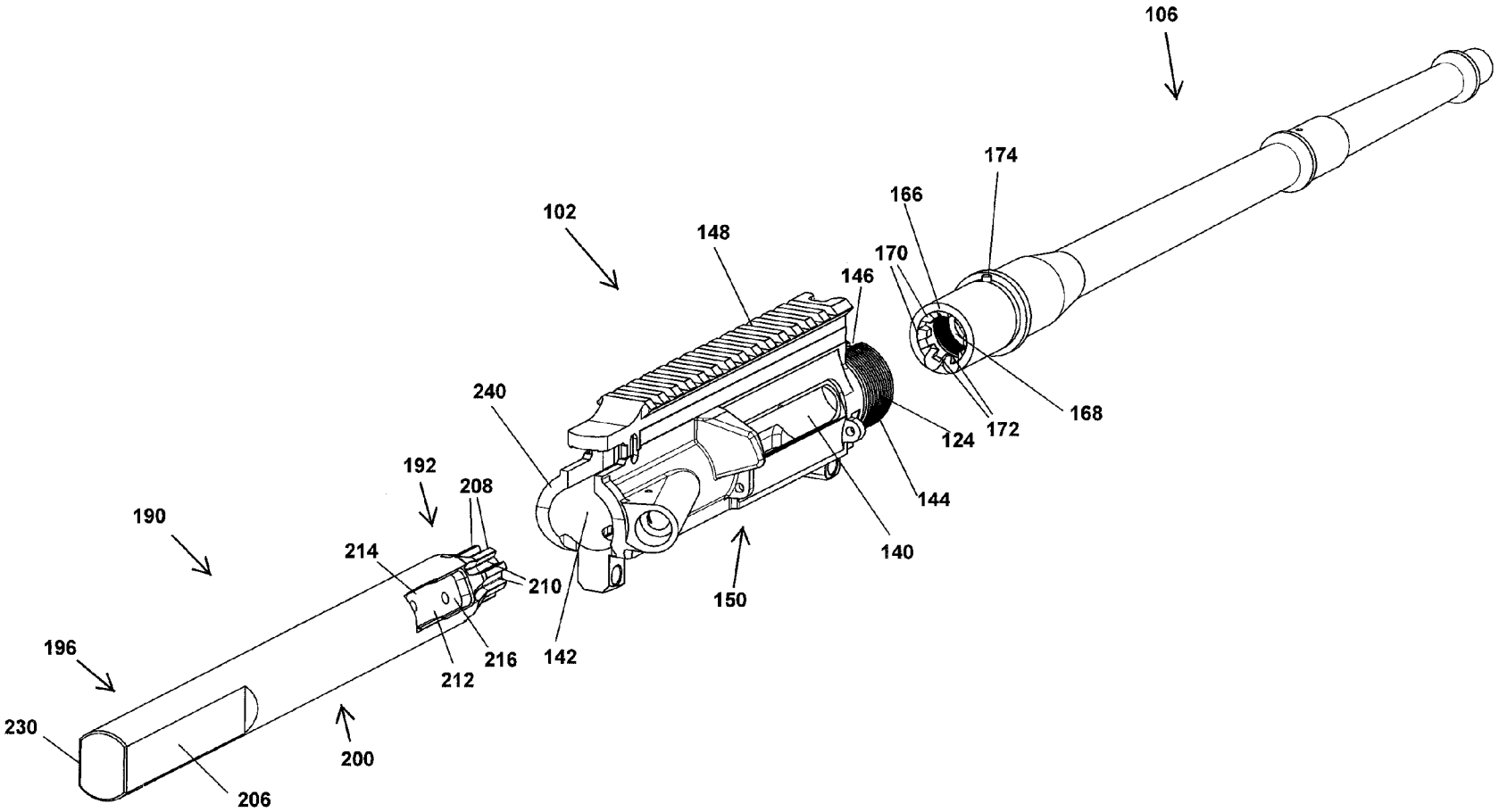
FIG. 8 is a perspective view of an armorer tool in accordance with the present disclosure, an example firearm upper receiver, and an example firearm barrel, shown prior to using the armorer tool during the process of mounting the barrel to the upper receiver.

FIG. 8 is a perspective view of the example armorer tool 190 in accordance with the present disclosure, the example firearm upper receiver 102, and the example firearm barrel 106, shown prior to using the armorer tool 190 during the process of mounting the barrel to the upper receiver with a barrel nut (such as the barrel nut 110 in FIG. 1). The example upper receiver 102 includes the barrel receiving end 124, the ejection port 140, the cavity 142, the screw threads 144, the recess 146, the top 148 and the bottom 150, as discussed above. The example barrel 106 includes the barrel nut extension 164 having the rear end 166, the interior bore 168, the lugs 170, the spaces 172, and the pin 174 as discussed above. The example armorer tool 190 includes the front portion 192, the rear portion 196, the body portion 200, the surface 206, the splines 208, the grooves 210, the well 212 having the rear portion 214 and the front portion 216, and the surface 230 as discussed above. In this example, the armorer tool 190 differs from that shown in FIG. 4 in that the removable protrusions 218*a* and 218*b*, and screws 220 (see FIG. 4), have been removed. Additionally in this example, the upper receiver 102 includes a rear end 240.

With reference to FIG. 8, to use the example armorer tool 190 as an aid to mounting the example barrel 106 onto the example upper receiver 102, the armorer tool 190 is inserted into the cavity 142 of the upper receiver 102. To do so, the front portion 192 of the armorer tool 190 is inserted into the cavity 142 at the rear end 240 of the upper receiver 102. The barrel nut extension 164 of the barrel 106 is placed inside the barrel receiving end 124 of the upper receiver 102, such that the pin 174 and the recess 146 nest together, the splines 208 on the front portion 192 of the armorer tool 190 mate with the spaces 172 in the barrel 106, and the grooves 210 on the front portion 192 of the armorer tool 190 mate with the lugs 170 in the barrel 106. Thus, in this example, the armorer tool 190 mates with the barrel 106 inside the barrel receiving end 124 of the upper receiver 102.

Figure 10:
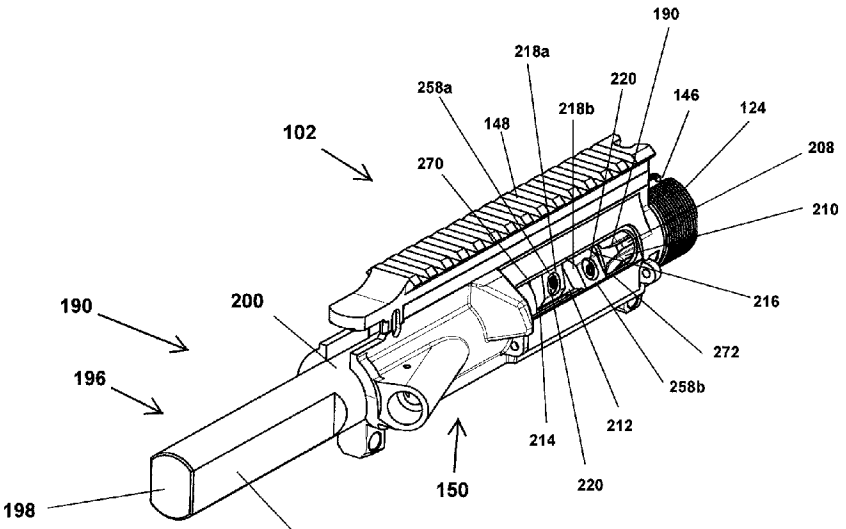
FIG. 10 is a top, rear, right side perspective view showing an example armorer tool in accordance with the present disclosure inserted in an example firearm upper receiver.
Figure 11:
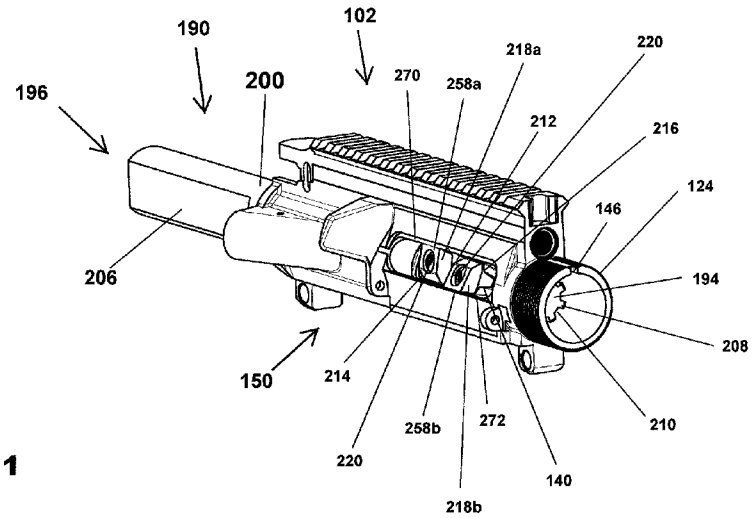
FIG. 11 is a top, front, right side perspective view of the armorer tool and upper receiver combination of FIG. 10.
Figure 12:
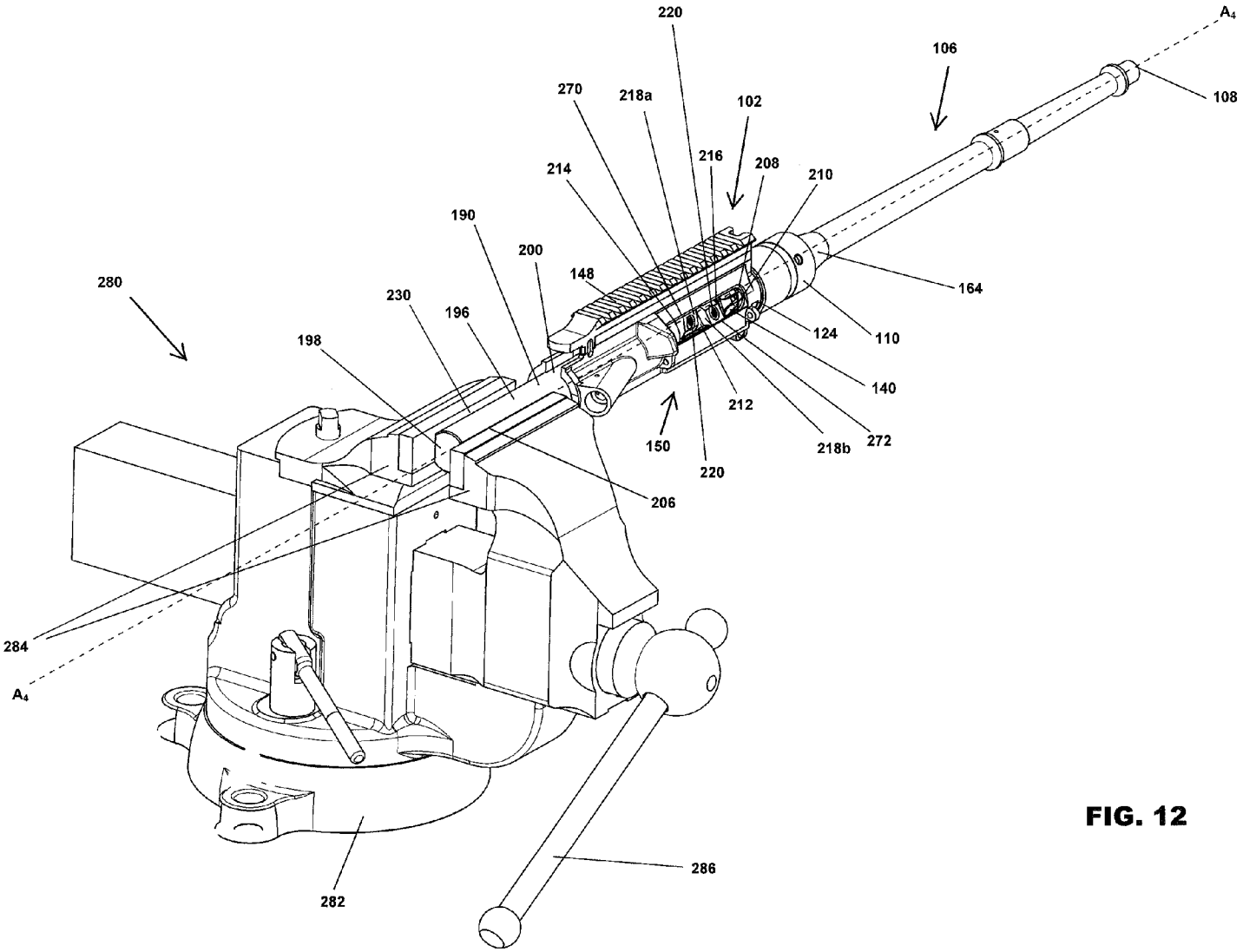
FIG. 12 is a top, rear, right side perspective view of a combination of an example firearm upper receiver, an example firearm barrel, and an example armorer tool consistent with the present disclosure, shown secured in a vise.

Also in this example, when the armorer tool 190 is mated with the barrel 106 as just described, the well 212 in the body portion 200 of the armorer tool 190 is aligned with the ejection port 140 of the upper receiver 102 (as illustrated in the examples shown in FIGS. 10-12). The angles $\alpha$ and $\beta$ discussed above in connection FIG. 7 are such that both the rear portion 214 and the front portion 216 thereof are aligned with ejection port 140 in the upper receiver 102 when the surfaces 206 and 230 are perpendicular to the top 148 of the upper receiver 102.

Once the armorer tool 190 has been mated with the barrel 106 inside the upper receiver 102 as just described, the protrusions 218*a* and 218*b* (see FIG. 4) are then secured to the well 212 as described below in connection with FIG. 9.

Figure 9:
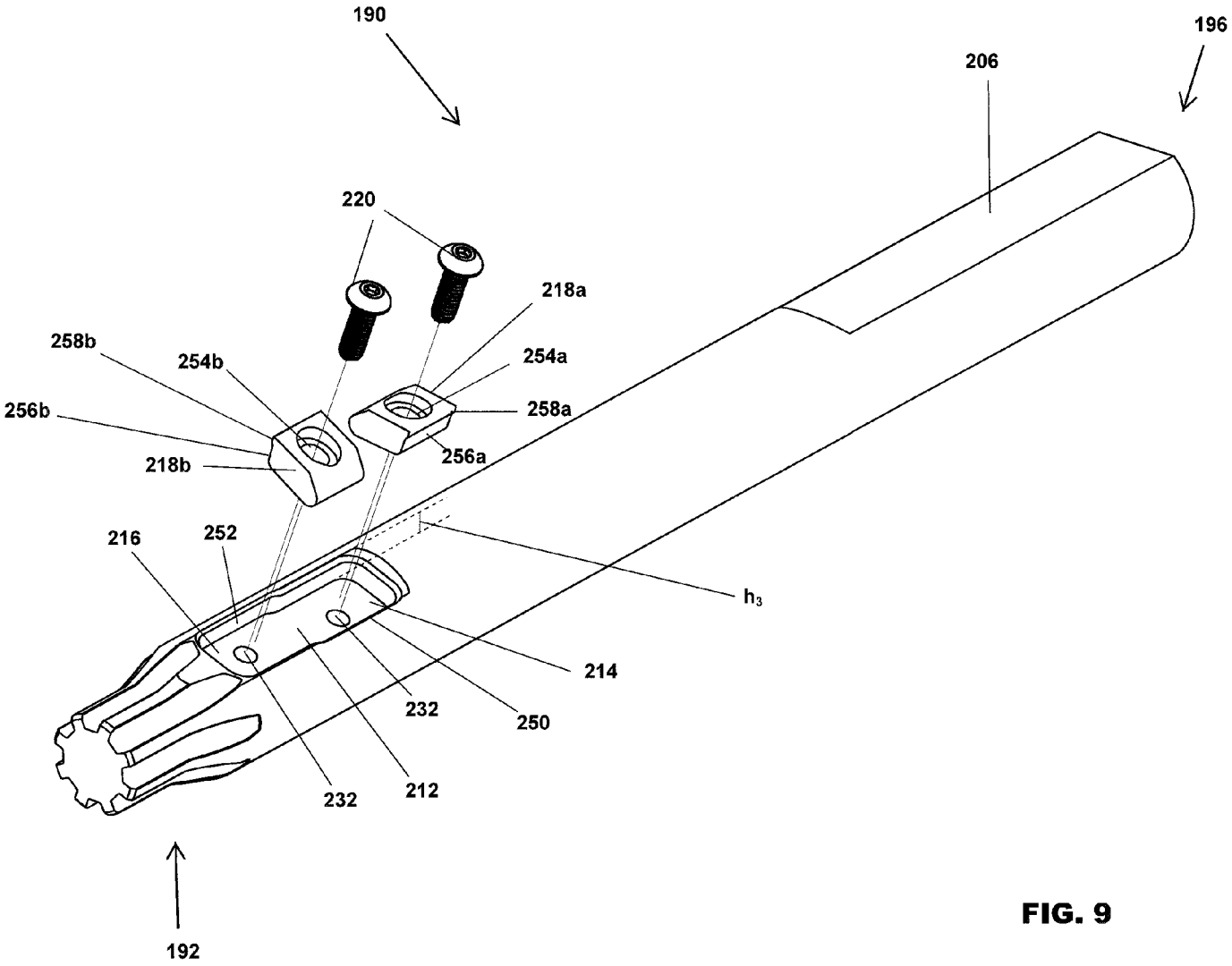
FIG. 9 is a front, top, right side, exploded perspective view of the armorer tool of FIG. 4.

FIG. 9 is a front, top, right side, exploded perspective view of the armorer tool 190 of FIG. 4. In this example, the armorer tool 190 includes the front portion 192, the rear portion 196, the body portion 200, the top 202, the surface 206, the well 212 having the rear portion 214 and the front portion 216, the protrusions 218*a* and 218*b*, the screws 220, and the screw holes 232 as discussed above. In addition, in this example, the rear portion 214 of the well 212 includes an upper wall 250, and the front portion 216 of the well 212 includes a lower wall 252. In addition, the protrusions 218*a* and 218*b* include, respectively, openings 254*a* and 254*b*, sides 256*a* and 256*b*, and ridges 258*a* and 258*b*.

The upper wall 250 bounds the top of the rear portion 214 of the well 212. The lower wall 252 bounds the bottom of the front portion 216 of the well 212. The upper wall 250 and the lower wall 252 have a height $h_3$, which corresponds to the depth of the well 212. In one example embodiment $h_3$ is about 5 mm. In alternative embodiments $h_3$ is in a range from about 0 mm to about 12 mm. In further alternative embodiments, the armorer tool does not have a well and one or more protrusions is/are secured directly to the outside of the body portion of the armorer tool.

The openings 254*a* and 254*b* can be, though need not be, threaded, and receive the screws 220 to secure the protrusions 218*a* and 218*b* to the well 212. When the protrusions 218*a* and 218*b* are secured to the well 212, the side 256*a* of the protrusion 218*a* faces the upper wall 250 of the rear portion 214 of the well 212, and the side 256*b* of the protrusion 218*b* faces the lower wall 252 of the front portion 216 of the well 212. In addition, in this example, the ridge 258*a* extends above and over the top of the upper wall 250, and the ridge 258*b* extends above and over the top of the lower wall 252 when the protrusions 218*a* and 218*b* are secured to the well 212. The protrusions 218*a* and 218*b* are secured to the well 212 by screwing the screws 220 into the screw holes 232 in the well 212.

In this example armorer tool 190, when the protrusions 218*a* and 218*b* are secured with the screws 220 to the rear portion 214 and the front portion 216, respectively, of the well 218 after the armorer tool 190 has been inserted into an upper receiver of a firearm (such as was described above in connection with FIG. 8), one or both of the ridges 258*a* and 258*b* contact the ejection port of the upper receiver without any further rotational adjustment required. In an example alternative configuration, when the protrusions 218*a* and 218*b* are secured with screws 220 to the rear portion 214 and the front portion 216, respectively, of the well 218 after the armorer tool 190 has been inserted into an upper receiver of a firearm (such as was described above in connection with FIG. 8), the ridges 258*a* and 258*b* are disposed such that slight rotational adjustment of the upper receiver results in either the ridge 258*a* or the ridge 258*b* contacting the ejection port of the upper receiver. This is described in greater detail below in connection with FIGS. 10-11. In a further alternative example configuration in which the ejection port of the upper receiver is too wide relative to the size of the protrusions, one or more shims or other appropriate space fillers, is inserted between the one or more protrusions and the wall of the ejection port to reduce or eliminate any gaps between the ejection port and the protrusion(s). In one example, each space filler is a brass shim approximately 0.5 mm in thickness.

FIG. 10 is a top, rear, right side perspective view showing an example armorer tool 190 in accordance with the present disclosure inserted in an example firearm upper receiver 102. FIG. 11 is a top, front, right side perspective view of the armorer tool 190 and upper receiver 102 combination of FIG. 10. As shown in FIGS. 10-11, the example upper receiver 102 includes the barrel receiving end 124, the ejection port 140, the recess 146, the top 148, and the bottom 150, as discussed above. The example armorer tool 190 includes the front end 194, the rear portion 196, the rear end 198, the body portion 200, the surface 206, the splines 208, the grooves 210, the well 212 having the rear portion 214 and the front portion 216, the protrusions 218*a* and 218*b*, the screws 220, and the protrusion ridges 258*a* and 258*b* as discussed above. In addition, in this example, the ejection port 140 of the upper receiver 102 includes an upper rim 270 and a lower rim 272.

In this example combination of armorer tool 190 and upper receiver 102, the armorer tool 190, without the protrusions 218*a* and 218*b*, and without the screws 220, has been inserted into the upper receiver 102 (as described above) such that the well 212 of the armorer tool 190 is aligned with the ejection port 140 of the upper receiver 201. In addition, the protrusions 218*a* and 218*b* have been secured to the well 212 with screws 220 as discussed above in connection with FIG. 9.

As shown in FIGS. 10-11, the protrusion 218*a* has been secured to the well 212 such that the ridge 258*a* of the protrusion 218*a* contacts the upper rim 270 of the ejection port 140. Similarly, the protrusion 218*b* has been secured to the well 212 such that the ridge 258*b* of the protrusion 218*b* contacts the lower rim 272 of the ejection port 140. In this example armorer tool 190, the rear portion 214 and the front portion 216 are offset from each other (as discussed above) to aid in securing the protrusions 218*a* and 218*b* into the well 212 when the armorer tool 190 is disposed within a firearm upper receiver. More specifically, the offset between the rear portion 214 and the front portion 216 provides a gap between the protrusion 218*a* and the lower rim 272 of the ejection port 140, and a gap between the protrusion 218*b* and the upper rim 270 of the ejection port 140. These gaps can facilitate installation and removal of the protrusions 218*a* and 218*b* by providing space with which to maneuver the protrusions inside the well 212.

When mounting a barrel nut to a barrel and upper receiver (discussed further below in connection with FIG. 12), the ridge 258*b* of the protrusion 218*b* transfers at least a portion of the frictional torque that would otherwise be applied to the recess 146 of the upper receiver 102 and the pin of a firearm barrel (such as the pin 174 in FIG. 8) to the lower rim 277 of the ejection port 140. Similarly, when removing a barrel nut from a barrel and upper receiver as discussed below in connection with FIG. 12, the ridge 258*a* of the protrusion 218*a* transfers at least a portion of the frictional torque that would otherwise be applied to the recess 146 of the upper receiver 102 and the pin of a firearm barrel (such as pin 174 in FIG. 8) to the upper rim 270 of the ejection port 140. Transference of torque from the pin and the recess 146 over to the ejection port 140 can reduce or prevent damage to the pin and recess during the torqueing process and, in general, distributes the frictional torque over a larger area, thereby reducing points of undesirable stress on the upper receiver or barrel of the firearm that could otherwise occur when mounting or removing a barrel nut.

FIG. 12 is a top, rear, right side perspective view of a combination of an example firearm upper receiver 102, an example firearm barrel 106, and an example armorer tool 190 consistent with the present disclosure, shown secured in a support mechanism 280. As shown in FIG. 12, the example barrel 106 includes the muzzle 108 and the barrel nut extension 164 about which the barrel nut 110 has been secured, as discussed above. The example upper receiver 102 includes the barrel receiving end 124, the ejection port 140, the recess 146, the top 148, and the bottom 150, as discussed above. The ejection port 140 includes the upper rim 270 and the lower rim 272, as also discussed above. The example armorer tool 190 includes the rear portion 196, the rear end 198, the body portion 200, the surface 206, the splines 208, the grooves 210, the well 212 having the rear portion 214 and the front portion 216, the protrusions 218*a* and 218*b*, the screws 220, and the surface 230, as discussed above. In addition, in this example, an example support mechanism 280 is shown. The example support mechanism 280 generally includes a base 282, jaws 284, and a crank 286.

The base 282 of the example support mechanism 280 is typically secured to a work surface or work bench during operation of the support mechanism 280. In this example, the jaws 284 hold the rear portion 196 of the armorer tool 190 by sandwiching and squeezing the opposing surfaces 206 and 230 of the armorer tool 190. The crank 286 is used to rotate a screw that moves the jaws 284 closer together or farther apart, thereby allowing the support mechanism 280 to alternatively secure or release the armorer tool 190. It should be noted that the armorer tool 190 can be mounted in a variety of orientations relative to the jaws 284 of the support mechanism 280 in addition to the orientation shown.

In this example combination of the armorer tool 190, the upper receiver 102, and the barrel 106, the armorer tool 190, without the protrusions 218*a* and 218*b*, and without the screws 220, has been secured to support mechanism 280 and the upper receiver 102 has been slid over the armorer tool 190 (as described above) such that well 212 of the armorer tool 190 is aligned with the ejection port 140 of the upper receiver 102. In addition, in the example combination shown, the barrel nut extension 164 of the barrel 106 has been inserted into the barrel receiving end 124 of the upper receiver 102 such that the splines 208 and the grooves 210 on the armorer tool 190 have mated with the corresponding spaces and lugs, respectively (not shown), in the barrel nut extension 164 of the barrel 106, as also discussed above. In addition, in the example combination shown, the protrusions 218*a* and 218*b* have been secured to the well 212 with the screws 220 as discussed above in connection with FIG. 9. In addition, in the example combination shown, the barrel nut 110 has been secured around the barrel receiving end 124 and the barrel nut extension 164, resulting in the illustration in the figure.

In securing the barrel nut 110 around the barrel receiving end 124 and the barrel nut extension 164, torque is applied to the barrel nut 110 in a counterclockwise direction about the axis $A_4$ in the figure. Frictional torque between the barrel nut 110 and the barrel nut extension 164 results from this counterclockwise torque. Because the armorer tool 190 is secured to the barrel 106, this frictional torque is transferred to support mechanism 280 through the armorer tool 190. Additionally, when securing the barrel nut 110 around the barrel receiving end 124 and the barrel nut extension 164 as just described, the frictional torque also results between the barrel nut 110 and the barrel receiving end 124, which tends to rotate the upper receiver 102 in a counterclockwise direction about the axis $A_4$. This frictional torque, however, is absorbed by the protrusion 218*b* of armorer tool 190, which protrusion contacts the lower rim 272 of the ejection port 140, preventing counterclockwise rotation about the axis $A_4$ of the upper receiver 102. In this manner, the protrusion 218*b* operates to relieve the stress on other parts of the barrel and upper receiver combination, which are more easily damaged, such as the pin 174 and the recess 146 fitting described above in connection with FIG. 8.

In removing the barrel nut 110 from the barrel receiving end 124 and the barrel nut extension 164, torque is applied to the barrel nut 110 in a clockwise direction about the axis $A_4$ in the figure. Frictional torque between the barrel nut 110 and the barrel nut extension 164 results from this clockwise torque. Because the armorer tool 190 is secured to the barrel 106, this frictional torque is transferred to the vise 280 through the armorer tool 190. Additionally, when removing the barrel nut 110 from the barrel receiving end 124 and the barrel nut extension 164 as just described, frictional torque also results between the barrel nut 110 and the barrel receiving end 124, which tends to rotate the upper receiver 102 in a clockwise direction about the axis $A_4$. This frictional torque, however, is absorbed by the protrusion 218*a* of the armorer tool 190, which protrusion contacts the upper rim 270 of the ejection port 140, preventing clockwise rotation about the axis $A_4$ of the upper receiver 102. In this manner, the protrusion 218*a* operates to relieve the stress on other parts of the barrel and the upper receiver combination that are more easily damaged from stress, such as the pin 174 and the recess 146 fitting described above in connection with FIG. 8.

In some examples, the elongate member 191 (FIG. 4) of the example armorer tool 190 is machined from a block of metal or metal alloy, e.g. stainless steel. In one example embodiment, a 4140 steel is used. In other examples, the elongate member 191 (FIG. 4) is cast from metal or a metal alloy. In some examples of the armorer tool 190, all features of the elongate member 191 (FIG. 4) of the armorer tool 190 (i.e., all features other than the protrusions 218*a* and 218*b* and screws 220) are cast together in a single mold or, alternatively, machined from a single block of material. In alternative embodiments, one or more features of the armorer tool 190 are machined following a casting process or initial machining process, such as the well 212, the splines 208, the grooves 210, the screw holes 232 (FIG. 5) and/or the surfaces 206 and 230. In some examples, the protrusions 218*a* and 218*b* are machined or cast from a softer metal or metal alloy (e.g., brass) than the firearm upper receiver(s) with which the armorer tool is to be used, in order to avoid scratching or other unwanted damage to the upper receiver of the firearm when the protrusions 218*a* and 218*b* come into torqued contact with the upper receiver. In alternative examples, other suitably strong and rigid materials may be used for the armorer tool 190 and/or the protrusions 218*a* and 218*b* and the screws 220.

It should be noted that use of an armorer tool in accordance with the present disclosure with a support mechanism is not limited to one involving the firearm components shown in FIG. 12. More or fewer firearm components can be involved than those shown in the firearm assembly of FIG. 12. By way of non-limiting example, the upper receiver can be connected to all or part of a lower receiver of a firearm when used with the armorer tool 190.

Figure 13:
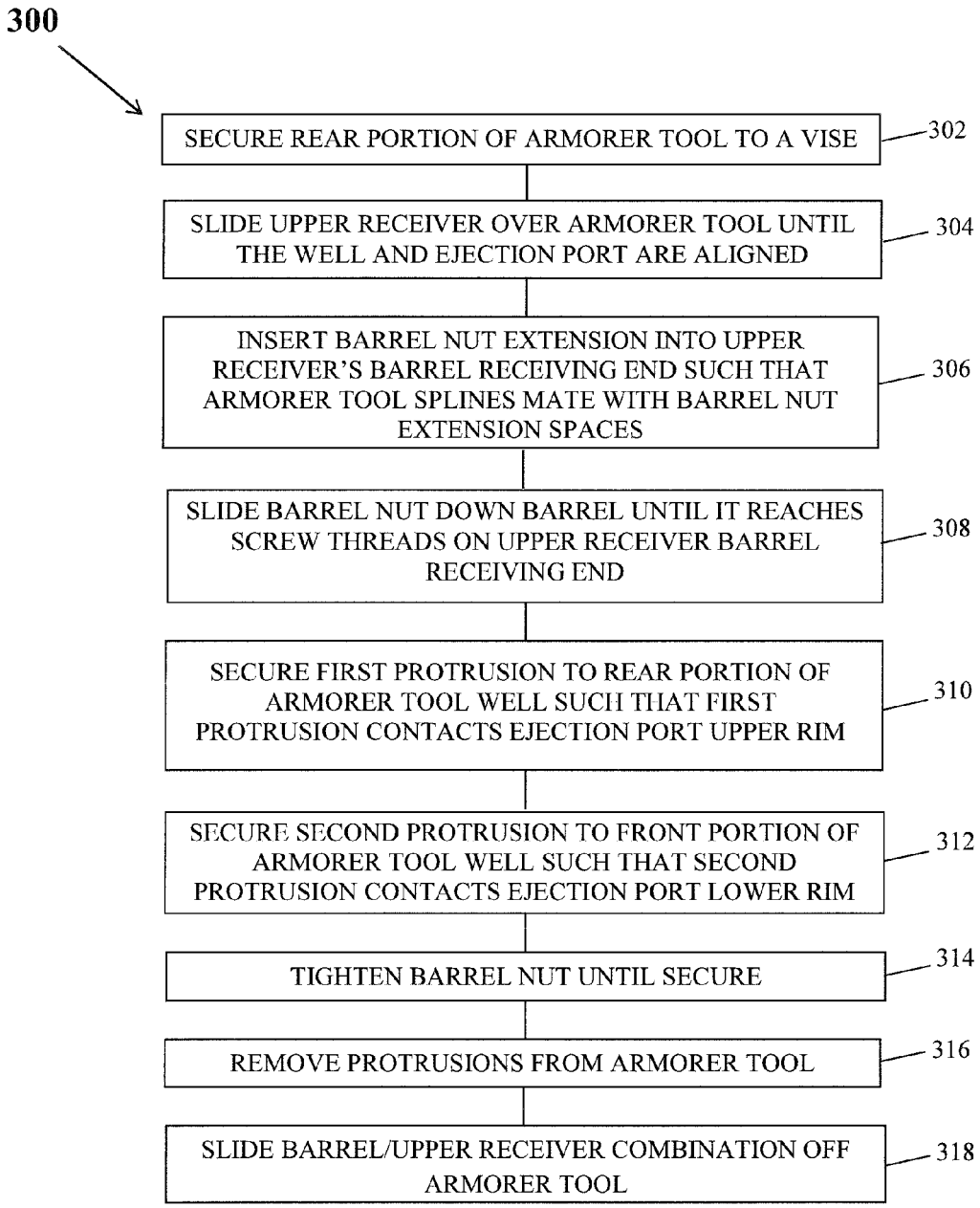
FIG. 13 illustrates an example method of using an armorer tool consistent with the present disclosure to mount a barrel nut to a firearm upper receiver and firearm barrel.

FIG. 13 illustrates an example method of using an armorer tool consistent with the present disclosure to mount a barrel nut to a firearm upper receiver and firearm barrel. The example method 300 includes operations 302, 304, 306, 308, 310, 312, 314, 316, and 318.

In accordance with this example method 300, in an operation 302 the rear portion of the armorer tool (such as the rear portion 196 in FIG. 4) is secured in a vise. In one example method, this is accomplished by sandwiching opposing flattened sides of the armorer tool's rear portion between the jaws of a vise or other support mechanism and tightening the vise to squeeze the armorer tool securely. In an operation 304, the upper receiver of a firearm is slid over the armorer tool until the ejection port of the upper receiver and the well of the armorer tool are aligned. In one example method, the upper receiver is slid starting with its rear end (i.e. the end opposite the end where the barrel is mounted) over the armorer tool, starting with its front end (i.e. the end opposite the end secured to the vise). In an operation 306, the barrel nut extension portion of a firearm barrel is inserted into the upper receiver's barrel receiving end at the front of the upper receiver, such that the splines on the front portion of the armorer tool mate with the corresponding spaces between the lugs inside the barrel nut extension of the barrel. In an operation 308, a barrel nut is slid down the barrel from the muzzle end until it reaches the screw threads on the barrel receiving end of the upper receiver and the barrel nut is lightly screwed (e.g., with a tool or by hand) in place. In an operation 310, a first protrusion is secured to the rear portion of the well of the armorer tool such that the first protrusion contacts the upper rim of the ejection port of the upper receiver. In an alternative example method, when the first protrusion is secured to the well, it only contacts the ejection port upon slight rotational adjustment of the upper receiver relative to the armorer tool. In an example embodiment, the first protrusion is secured to the armorer tool by screwing it into the bottom of the well of the armorer tool. In an operation 312, a second protrusion is secured to the front portion of the well of the armorer tool such that second protrusion contacts the lower rim of the ejection port of the upper receiver. In an alternative example method, when the second protrusion is secured to the well, it only contacts the ejection port upon slight rotational adjustment of the upper receiver relative to the armorer tool. In a further alternative example method, the operation 312 is omitted, and any method operations, to the extent applicable, apply to the first protrusion only. In an example embodiment, the second protrusion is secured to the armorer tool by screwing it into the bottom of the well of the armorer tool. In an operation 314, the barrel nut is further screwed onto the barrel receiving end of the upper receiver until fully tightened. In one example embodiment of this method, the barrel nut is secured to the upper receiver with a barrel nut wrench. In an operation 316, the protrusions are removed from the armorer tool. In one example embodiment of this method, the protrusions are removed by unscrewing them from the well of the armorer tool. In an operation 318, the combination of the barrel and upper receiver, with the barrel now secured to the upper receiver by means of the barrel nut, are slid off the armorer tool. In alternative embodiments, one or both of the operations 316 and 318 are omitted or postponed and the barrel/upper receiver combination remains on the armorer tool until further maintenance, repair, or assembly of the firearm is completed.

Figure 14:
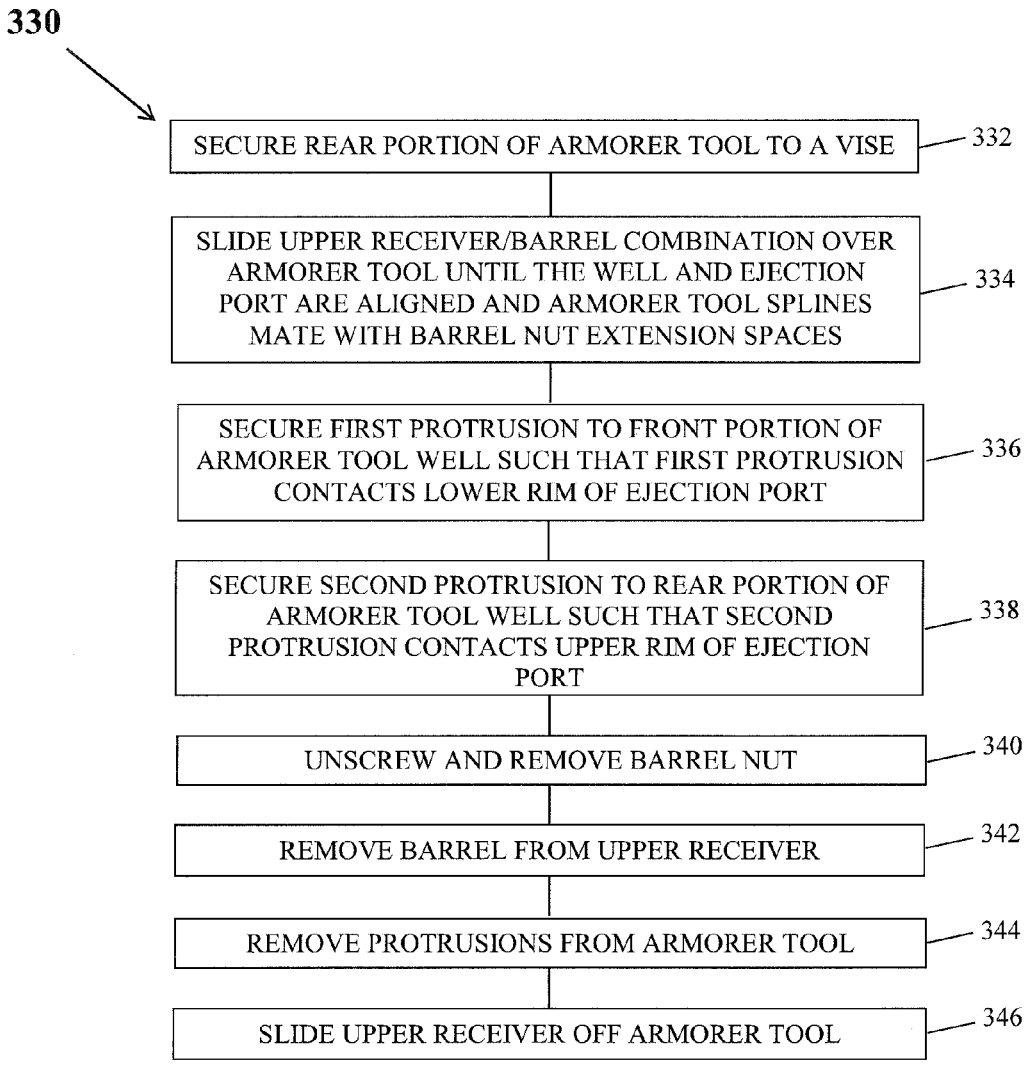
FIG. 14 illustrates an example method of using an armorer tool consistent with the present disclosure to remove a barrel nut from a firearm upper receiver and firearm barrel combination.

FIG. 14 illustrates an example method of using an armorer tool consistent with the present disclosure to remove a barrel nut from a firearm upper receiver and firearm barrel combination. The example method 330 includes operations 332, 334, 336, 338, 340, 342, 344, and 346.

In accordance with this example method 330, in an operation 332 the rear portion of the armorer tool (such as the rear portion 196 in FIG. 4) is secured in a vise. In one example method, this is accomplished by sandwiching opposing flattened sides of the armorer tool's rear portion between the jaws of a vise or other support mechanism and tightening the vise to squeeze the armorer tool securely. In an operation 334, the upper receiver/barrel combination is slid over the armorer tool until the well in the armorer tool and the ejection port in the upper receiver are aligned and the splines of the armorer tool are mated with the corresponding spaces between the lugs inside the barrel nut extension. In one example method, the upper receiver portion of the combination is slid starting with its rear end (i.e. the end opposite the barrel) over the armorer tool, starting with its front end (i.e. the end opposite the end secured to the vise). In an operation 336, a first protrusion is secured to the front portion of the armorer tool well such that the first protrusion contacts the lower rim of the ejection portion. In an alternative example method, when the first protrusion is secured to the well, it only contacts the ejection port upon slight rotational adjustment of the upper receiver relative to the armorer tool. In an example embodiment, the first protrusion is secured to the armorer tool by screwing it into the bottom of the well of the armorer tool. In an operation 338, a second protrusion is secured to the rear portion of the armorer tool well such that the second protrusion contacts the upper rim of the ejection port. In an alternative example method, when the second protrusion is secured to the well, it only contacts the ejection port upon slight rotational adjustment of the upper receiver relative to the armorer tool. In a further alternative example method, the operation 338 is omitted, and any method operations, to the extent applicable, apply to the first protrusion only. In an example embodiment, the second protrusion is secured to the armorer tool by screwing it into the bottom of the well of the armorer tool. In an operation 340, the barrel nut is unscrewed and removed from the barrel/upper receiver combination. In one example embodiment of this method, the barrel nut is unscrewed with a barrel nut wrench. In an operation 342, the barrel is extracted from the upper receiver for maintenance, repair, component installation, or the like. In an operation 344, the protrusions are removed from the armorer tool. In one example embodiment of this method, the protrusions are removed by unscrewing them from the well of the armorer tool. In an operation 346, the upper receiver and the barrel (now secured to the upper receiver by means of the barrel nut), are slid off the armorer tool. In alternative method embodiments, operations 344 and 346 precede operations 342. In further alternative methods one or more of operations 344, 346, and 348 are omitted or postponed and the barrel and/or upper receiver (without a barrel nut) remains on the armorer tool until further maintenance, repair or assembly of the firearm is completed.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. An armorer tool for use with a barrel and an upper receiver of a firearm comprising:

an elongate member comprising a front portion, a rear portion, and a body portion between the front portion and the rear portion, the front portion comprising a plurality of splines configured to mate with lugs of a barrel nut extension of the firearm barrel, the rear portion comprising a surface configured to mate with a support mechanism; and at least one protrusion protruding beyond a profile of the body portion and disposed on the body portion at a location configured to be aligned with an ejection port of the upper receiver when the armorer tool extends through the upper receiver and is mated to the barrel.

2. The armorer tool of claim 1, wherein the body portion comprises a well and the at least one protrusion is disposed in the well.

3. The armorer tool of claim 2, wherein the at least one protrusion is detachably mounted in the well.

4. The armorer tool claim of 3, wherein the well is aligned with an ejection port of the upper receiver when the armorer tool extends through the upper receiver and is mated to the barrel.

5. The armorer tool of claim 4, comprising at least two protrusions detachably mounted in the well.

6. The armorer tool of claim 5, comprising two protrusions, wherein the well comprises a front portion and a rear portion offset from the front portion, and wherein one of the two protrusions is detachably mounted in the front portion of the well, and the other protrusion is detachably mounted in the rear portion of the well.

7. The armorer tool of claim 6 wherein when the two protrusions are disposed in the well and the armorer tool extends through the upper receiver and is mated to the barrel of the firearm, the protrusion disposed in the rear portion of the well contacts an upper rim of the ejection port of the upper receiver, and the protrusion disposed in the front portion of the well contacts a lower rim of the ejection port of the upper receiver.

8. A method for securing a firearm barrel nut to a barrel and an upper receiver of a firearm using an armorer tool, the method comprising:

a. securing a rear portion of the armorer tool to a support mechanism b. sliding the upper receiver over the armorer tool until a well in the armorer tool is aligned with an ejection port in the upper receiver;

c. inserting a barrel into the upper receiver such that splines on a front end of the armorer tool mate with lugs of a barrel nut extension of the barrel;

d. securing a protrusion to the well of the armorer tool such that the protrusion contacts a rim surrounding the ejection port; and e. securing the barrel nut around the upper receiver and the barrel.

9. The method of claim 8 further comprising: subsequently removing the protrusion from the well of the armorer tool.

10. The method of claim 9 further comprising: subsequently sliding the barrel and the upper receiver off of the armorer tool.

11. The method of claim 8, wherein the protrusion is secured to a rear portion of the well and contacts an upper portion of the rim surrounding the ejection port.

12. The method of claim 11, wherein a second protrusion is secured to a front portion of the well that is offset from the rear portion of the well, such that the second protrusion contacts a lower portion of the rim surrounding the ejection port.

13. The method of claim 12, further comprising: subsequently removing both of the protrusions from the well of the armorer tool.

14. The method of claim 13 further comprising subsequently sliding the barrel and the upper receiver off of the armorer tool.

15. A method for removing a firearm barrel nut from a barrel and an upper receiver of a firearm using an armorer tool, the method comprising:

a. securing a rear portion of the armorer tool to a support mechanism;

b. sliding the upper receiver and the barrel over the armorer tool until a well in the armorer tool is aligned with an ejection port in the upper receiver and splines on the armorer tool mate with lugs of a barrel nut extension of the barrel;

c. securing a protrusion to the well of the armorer tool such that the protrusion contacts a rim surrounding the ejection port; and d. removing the barrel nut from the upper receiver and the barrel.

16. The method of claim 15 further comprising: subsequently removing the protrusion from the well of the armorer tool.

17. The method of claim 16 further comprising: subsequently removing the barrel from the upper receiver and sliding the upper receiver off of the armorer tool.

18. The method of claim 17, wherein the protrusion is secured to a front portion of the well and contacts a lower portion of the rim surrounding the ejection port.

19. The method of claim 18, wherein a second protrusion is secured to a rear portion of the well that is offset from the front portion of the well, such that the second protrusion contacts an upper portion of the rim surrounding the ejection port.

20. The method of claim 19 further comprising: subsequently removing both of the protrusions from the well of the armorer tool, removing the barrel from the upper receiver, and sliding the upper receiver off of the armorer tool.

* * * * *